US006099397A

United States Patent [19]

Wurst

[11] Patent Number: 6,099,397

[45] Date of Patent: Aug. 8, 2000

[54] POWER SANDER

[75] Inventor: Bert G. Wurst, Stuttgart, Germany

[73] Assignee: C. & E. Fein GmbH & Co., Germany

[21] Appl. No.: 09/263,604

[22] Filed: Mar. 5, 1999

[30] Foreign Application Priority Data

Mar. 7, 1998 [DE] Germany ..... 198 09 937

[51] Int. Cl.[7] ..... B24B 23/00

[52] U.S. Cl. ..... 451/344; 451/356; 451/163

[58] Field of Search ..... 451/344, 351, 451/353, 356, 357, 359, 163, 174, 175

[56] References Cited

U.S. PATENT DOCUMENTS 4,920,702 5/1990 Kloss et al. ..... 451/344

5,441,450 8/1995 Fein et al. ..... 451/357

FOREIGN PATENT DOCUMENTS 43 14 799 C2 4/1995 Germany .

*Primary Examiner*—Rodney A. Butler
*Attorney, Agent, or Firm*—Cummings & Lockwood

[57] ABSTRACT

A power sander comprising an oscillating drive for oscillatingly driving a sanding tool about an axis fixed with respect to a housing is disclosed. The sanding tool comprises a sanding plate arranged on the sanding tool and having at least two side edges which converge in at least one corner and are arranged symmetrically with respect to a center point. A receptacle for mounting the sanding plate on the drive shaft is arranged on the sanding plate eccentrically with respect to the center point.

20 Claims, 1 Drawing Sheet

POWER SANDER

BACKGROUND OF THE INVENTION

The invention concerns a power sander having an oscillating drive system for oscillating driving of a sanding tool about a device-mounted drive shaft, the sanding tool having a sanding plate with at least two preferably convexly outwardly curved side edges which converge in at least one corner and are arranged symmetrically with respect to a center point, wherein the sanding plate has a receptacle for mounting on the drive shaft.

The invention further concerns a sanding tool that is suitable for use with a power sander of this kind.

A power sander and sanding tool of this kind are known from U.S. Pat. No. 4,920,702.

The known sanding tool has an oscillation drive system with which a drive shaft can be pivoted back and forth at high frequency and with a small pivot angle. The sanding tool is joined to the drive shaft in the center of its sanding surface, which is preferably triangular in shape with convexly outwardly curved side edges. The sanding tool thus executes a pivoting movement about the drive shaft, the center of the pivoting movement lying in the drive shaft. The corner regions thus experience the greatest excursion, being pivoted back and forth along circle segments. A movement of this kind also occurs at the side edges, which are preferably convexly outwardly curved. In the center of the sanding tool at which it is centrally joined to the drive shaft, however, the sanding effect is extremely small, since here the individual sanding particles on the sanding tool travel only extremely small distances; in the center, practically all that occurs is a back-and-forth rotation about the shaft.

The known power sander has proven extremely advantageous for performing difficult sanding or polishing tasks in poorly accessible areas; because of the type of drive system and the movement pattern of the sanding tool, work can be performed especially advantageously along internal longitudinal edges and into corners.

A certain disadvantage which has emerged in this context is that the sanding effect is confined predominantly to the side edges and the corners of the sanding tool, while the sanding effect occurring in the center of the sanding tool is very small or practically absent. The result is that the sanding tool, or the pieces of sandpaper which are usually mounted detachably thereon, must be frequently replaced because severe wear occurs at the edge regions, while the relevant sanding medium is only slightly worn away in the central regions. Despite the fact that with a sanding tool of this kind, sanding tasks can be performed extremely advantageously in poorly accessible areas, this inadequate sanding effect in the central region of the sanding tool is regarded by many users as disadvantageous, so that the power sander is used less for work on flat areas.

SUMMARY OF THE INVENTION

It is thus the object of the invention to improve a power sander and a sanding tool of the kind recited initially in such a way that the sanding effect in the central region of the sanding tool is enhanced, while the capability of working along internal longitudinal edges is nevertheless to be retained.

The object of the invention is achieved, in a power sander and a sanding tool of the kind recited initially, in that the receptacle is arranged on the sanding plate eccentrically, with respect to the center point.

The object of the invention is completely achieved in this manner.

According to the present invention, the result of offsetting the receptacle outward from the center point of the sanding plate is that because of the greater spacing from the drive shaft, a greatly increased sanding effect occurs in the central region of the sanding tool. At the same time, the sanding effect in the region of the opposite corner is increased. There also results, as before, a movement in the region of the side edges of the sanding tool which goes approximately back and forth on a circle segment along a side edge of the sanding tool. In the regions of the sanding plate which are located on the side edges at a greater distance from the connecting point between drive shaft and sanding plate, the movement extends along circle segments which are slightly inclined with respect to the side edge. Despite this slight inclination, it is also possible to work well with the side edges along internal longitudinal edges, since the side edges can "roll" effectively along an internal longitudinal edge so that only slight vibrations occur when working along internal longitudinal edges. The overall result is thus a greatly improved sanding effect in the central region of the sanding tool, while it is still advantageously possible, as in the existing art, to work along internal longitudinal edges.

According to a development of the invention, the sanding plate has an adjustable joining element for mounting the sanding plate in various positions on the drive shaft.

The advantage of this feature is that the user can adjust the sanding tool selectably depending on the work to be performed, so as thereby to achieve either a much greater sanding effect in the central region and in one corner, or to ensure less vibration when working along internal longitudinal edges.

According to a development of this embodiment, the joining element comprises an elongated hole through which a mounting element can be joined to the drive shaft in various positions.

The result is to achieve the adjustment capability with particularly simple means; a screw which can be threaded into a blind threaded hole in the drive shaft can be provided, for example, as the mounting element.

According to a further embodiment of the invention, the sanding plate has at least one eccentrically arranged mounting opening for receiving a mounting element.

Although this embodiment does away with the advantages associated with an adjustable joining capability, the overall configuration of the sanding plate is simplified, and moreover the recess in the sanding plate necessary for a mount becomes smaller, so that the absence of support, for example when a piece of sandpaper is mounted with a hook-and-loop fastener on the underside of the sanding plate, creates practically no disadvantages during sanding.

It also is possible in this context, of course, to provide for the user a selection of different sanding tools in which the relevant mounting openings are located either centrally, slightly eccentrically, or highly eccentrically, so that the user can use the appropriate sanding tool for the work to be performed.

According to a further embodiment of the invention, the sanding plate has a plurality of mounting openings.

The result, with only a single sanding plate, is either to create an adjustment capability for influencing the sanding effect, or to allow the user to rotate the sanding plate after wear has occurred in one corner, and mount it with a different corner facing forward, so as then to utilize a region of the sanding tool which is not so heavily worn.

In a preferred embodiment of the invention, the sanding plate is of triangular configuration and has convexly outwardly curved side edges.

The result, especially in conjunction with this shape of the sanding tool already known per se, is a particularly advantageous movement pattern, in particular allowing especially low-vibration utilization along internal longitudinal edges.

In a preferred development of this embodiment, the receptacle has at least one mounting opening which is offset from the center point of the sanding plate out toward an adjacent side edge, on a connecting line running through the center point and an opposite corner.

This kind of arrangement of the mounting opening on the sanding plate allows a symmetrical movement pattern to be achieved, so that the principal sanding effect occurs at the opposite corner, and so that work can be performed with both side edges uniformly along internal longitudinal edges.

According to a further embodiment of the invention, the sanding plate has at least one mounting opening arranged in the region of one corner.

When the device-mounted drive shaft is joined to the sanding plate in the region of one corner, the result is a particularly pronounced sanding effect in the region of the opposite edge, so as thereby to achieve a pronounced sanding effect and to be able to sand along longitudinal edges.

It is understood that the features mentioned above and those yet to be explained below can be used not only in the respective combinations indicated, but also in other combinations or in isolation, without leaving the context of the present invention.

BRIEF DESCRIPTION OF THE DRAWINGS

Further features and advantages of the invention are apparent from the description below of preferred exemplifying embodiments, with reference to the drawings in which.

DESCRIPTION OF THE PREFERRED EMBODIMENTS

Figure 1:
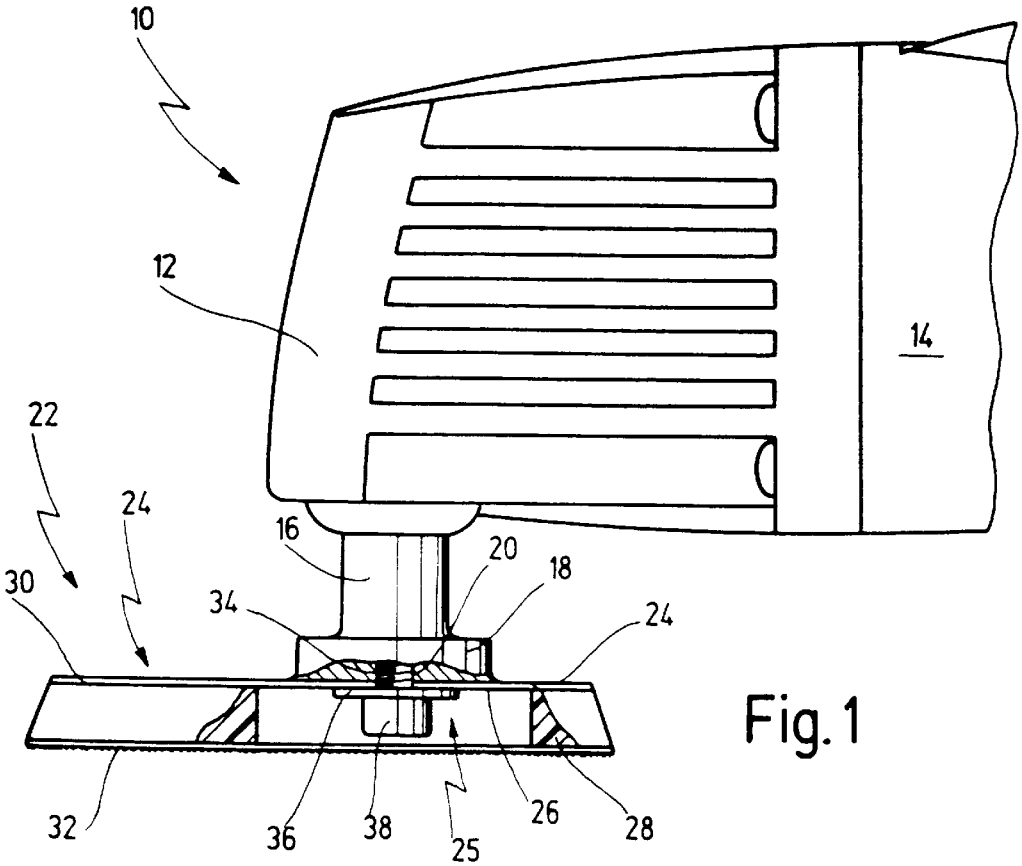
FIG. 1 shows a partial side view of a power sander according to the present invention in the front region of the housing, with the drive shaft and a sanding tool installed, in a partially sectioned representation.

Power sander 10 shown in FIG. 1 has a housing 12 which receives an electric-motor drive system, the rotary motion of which is converted in known fashion, by an oscillation drive system, into a back-and-forth pivoting movement of a drive shaft 16 with a small pivot angle on the order of approximately 0.5 to 7 degrees and at a relatively high frequency which is preferably greater than 5,000 oscillations per minute and optionally can be adjusted in a range approximately between 10,000 and 25,000 oscillations per minute.

The outer end of drive shaft 16 widens into a flange 18 on which a triangular sanding tool 22 can be mounted by way of a receptacle, labeled overall with the number 25, which is located outside the geometrical center point of sanding tool 22.

Except for the eccentric arrangement of receptacle 25, the configuration of sanding tool 22 is known per se. Sanding tool 22 comprises a sanding plate, labeled overall with the number 24, on whose underside remote from drive shaft 16 on the one hand a sanding medium can be applied, such being the case, for example, with diamond-coated sanding plates. On the other hand, as shown in the drawings, the underside of sanding plate 24 can also be equipped with a hook-and-loop adhesive material 32 so that a sanding medium, i.e. for example a piece of sandpaper that is equipped on its upper side with a suitable fabric material, can be simply pressed on so as thereby to allow an easily detachable join between a detachable sanding medium and sanding plate 24. Depending on the desired application, sanding tool 22 thus comprises either sanding plate 24 with a sanding medium coating on the underside, or sanding plate 24 and an associated sanding medium which can be mounted detachably on the underside of the sanding plate. It is understood that instead of a joining capability by way of a hook-and-loop fastener, it is also possible to consider, for example, an adhesive join using a detachable adhesive tape.

Sanding plate 24 has on its upper side a flat aluminum support 30 which is joined via an intermediate layer of foamed plastic 28 to hook-and-loop adhesive material 32, which is received on a suitable plastic layer.

Figure 2:
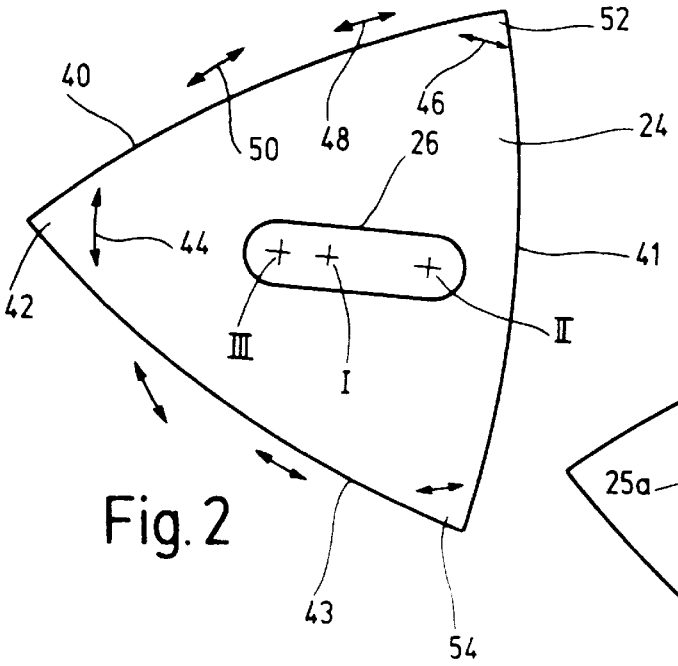
FIG. 2 shows a plan view from above of the sanding tool shown in FIG. 1.

The power sander according to the present invention differs from a power sander according to the existing art by having receptacle 25, which is shown in FIGS. 1 and 2.

In this embodiment, receptacle 25 has an elongated hole 26 which extends from geometrical center point I of sanding plate 24 out toward the adjacent side edge 41 along an imaginary connecting line to the opposite corner 42. Through this elongated hole 26, a mounting element in the form of a screw 38 can be threaded with its threads 34, through a washer 36, into a blind threaded hole 20 of drive shaft 16. Because the mounting opening is configured as an elongated hole 26, it is thus possible to adjust the geometrical location of the join between sanding plate 24 and drive shaft 16, i.e. displace it approximately from geometrical center point I to an end position II located remotely from the opposite corner 42, if a maximum possible excursion in the opposite corner region 42 and a greater sanding effect in the center region is desired; or shift it toward the opposite corner 42 to position III so as, for example, to achieve a lesser sanding effect in the region of the opposite corner 42.

Considering the movement pattern which results when sanding plate 24 is joined to drive shaft 16 at position II, the result of the greater distance from the center of the rotary movement to the opposite corner 42 is an increased excursion in the region of the corner indicated in FIG. 2 with arrow 44. Smaller excursions result, on the other hand, in the region of the two adjacent corners 52, 54, due to the smaller distance from the center of the rotary movement indicated in FIG. 2 with the number II. This is illustrated by the somewhat shorter double arrow 46 in FIG. 2.

Depending on the spacing from center II of the rotary movement, somewhat different movement components occur at the regions of sanding plate 24 along side edges 40, 43 which enclose corner 42. Along side edge 40, a sanding particle located at a point which is offset out from the remote corner 42, farther toward the corner 52 located closer to center II of the rotary movement, executes a pivoting movement on a circle segment which extends approximately in the direction of side edge 40, as indicated by double arrow 48. Considering a sanding particle which is located in a position shifted farther out from this point toward the remote corner 42, the result is once again a pivoting movement on a circle segment, but it is inclined at a small angle with respect to side edge 40, as indicated by double arrow 50.

In the case of mounting in position II, the result in the regions of the two corners 52, 54 is a lesser excursion with a movement component indicated by double arrow 46.

The overall result, in the case of mounting in position II, is thus a greater excursion in the region of corner 42, a lesser but still perceptible sanding effect in the center region of the sanding tool, and a lesser sanding effect also in the region of the two corners 52, 54 which are located closer to drive shaft 16 than the remote corner 42. As illustrated by arrows 48 and 50 in FIG. 2, largely vibration-free operation along internal longitudinal edges is thereby made possible.

Figure 3:
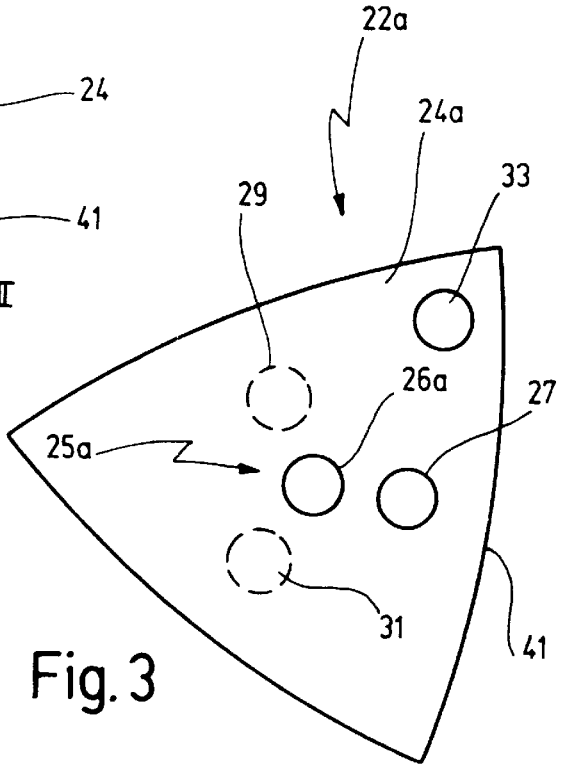
FIG. 3 shows a plan view of an alternative embodiment of the sanding tool.

FIG. 3 depicts, in plan view, a modification of the sanding tool according to the present invention, labeled overall with the number 22*a*. The receptacle (labeled overall with the number 25*a*) of sanding plate 24*a* comprises a total of four mounting openings, namely centrally arranged mounting opening 26*a* and one mounting opening 27 offset in the direction of side edge 41; two further mounting openings 29, 31 are provided only optionally, as intended to be illustrated by the dashed representation in FIG. 3. The one eccentrically arranged mounting opening 27 would be fundamentally sufficient to allow use of the advantages of the invention. Mounting opening 26*a* can, however, additionally be provided centrally so as also to allow, in addition to the eccentric arrangement, central mounting of the sanding tool on drive shaft 16, if it is necessary in certain applications to work in particularly vibration-free fashion.

It is also possible, by way of the further mounting openings 29, 31 which are preferably each offset correspondingly toward the opposite corner so as to result altogether in a symmetrical arrangement, to create a changeover capability, so that after sanding tool 22*a* has worn away in one corner, it is possible by rotation and mounting on another mounting opening to use the not-yet completely exhausted regions of the sanding or polishing medium.

In FIG. 3 a further mounting opening 33 is additionally provided in the region of one corner as another possibility. If the device-mounted drive shaft 16 is joined to this mounting opening 33, the result is a large sanding effect in the region of the opposite edge; this is advantageous, for example, when working along an internally located longitudinal edge. It is understood that in this case it is, of course, no longer possible to work into a corner, since the corners located opposite mounting opening 33 no longer pivot at a small angle but rather experience larger excursions as they move back and forth along a circle segment with respect to mounting opening 33.

What is claimed is:

1. A power sander comprising:

a housing;

a drive shaft having a longitudinal axis and being arranged at a fixed position within said housing pivotably about said longitudinal axis;

an oscillating drive arranged in said housing and coupled to said drive shaft for oscillatingly driving a sanding tool about said drive shaft in a pivot motion oscillating back and forth about said longitudinal axis;

a sanding plate arranged on said sanding tool, said sanding plate having a sanding surface encircled by a perimeter and having a center point, said center point having equal distance to each outermost point on said perimeter; and a receptacle for mounting said sanding plate on said drive shaft, said receptacle being arranged on said sanding plate at a position such that said longitudinal axis of said drive shaft intersects said sanding surface and is arranged at a radial distance from said center point.

2. The power sander of claim 1, wherein said side egdes are of outwardly curved configuration.

3. The power sander as defined in claim 1, wherein the sanding plate has an adjustable joining element for mounting the sanding plate in various positions on the drive shaft.

4. The power sander as defined in claim 1, wherein the sanding plate has at least one mounting opening being eccentrically arranged with respect to said drive axis for receiving a mounting element.

5. The power sander as defined in claim 1, wherein said sanding plate is of triangular configuration having a center point and convexly outwardly curved side edges.

6. The power sander as defined in claim 1, wherein said sanding plate comprises at least one mounting opening being arranged in the vicinity of one corner.

7. The power sander as defined in claim 3, wherein the joining element comprises an elongated hole adapted for joining a mounting element therethrough and attaching to the drive shaft in various positions.

8. The power sander as defined in claim 7, wherein said mounting element is configured as a screw and wherein said joining element comprises a threaded hole for receiving said screw.

9. The power sander as defined in claim 8, wherein a plurality of mounting openings is provided on said sanding plate.

10. The power sander as defined in claim 5, wherein said sanding plate receptacle comprises at least one mounting opening which is offset from said center point toward an adjacent side edge on a connecting line running through said center point and an opposite corner.

11. A sanding tool for a power sander comprising:

a drive shaft having a longitudinal axis and being arranged at a fixed position within a housing pivotably about said longitudinal axis;

an oscillating drive arranged in said housing and coupled to said drive shaft for oscillatingly driving said sanding tool about said drive shaft in a pivot motion oscillating back and forth about said longitudinal axis;

a sanding plate arranged on said sanding tool, said sanding plate having a sanding surface encircled by a perimeter and having a center point, said center point having equal distance to each outermost point on said perimeter; and a receptacle for mounting said sanding plate on said drive shaft, said receptacle being arranged on said sanding plate at a position such that said longitudinal axis of said drive shaft intersects said sanding surface and is arranged at a radial distance from said center point.

12. The sanding tool of claim 11, wherein said side egdes are of outwardly curved configuration.

13. The sanding tool as defined in claim 11, wherein the sanding plate has an adjustable joining element for mounting the sanding plate in various positions on the drive shaft.

14. The sanding tool as defined in claim 11, wherein the sanding plate has at least one mounting opening being eccentrically arranged with respect to said drive axis for receiving a mounting element.

15. The sanding tool as defined in claim 11, wherein a plurality of mounting openings is provided on said sanding plate.

16. The sanding tool as defined in claim 11, wherein said sanding plate is of triangular configuration having a center point and convexly outwardly curved side edges.

17. The sanding tool as defined in claim 11, wherein said sanding plate comprises at least one mounting opening being arranged in the vicinity of one corner.

18. The sanding tool as defined in claim 13, wherein the joining element defines an elongated hole adapted for joining a mounting element therethrough and attaching to the drive shaft in various positions.

19. The power sander as defined in claim 18, wherein said mounting element is configured as a screw and wherein said joining element comprises a threaded hole for receiving said screw.

20. The sanding tool as defined in claim 16, wherein said sanding plate receptacle comprises at least one mounting opening which is offset from said center point toward an adjacent side edge on a connecting line running through said center point and an opposite corner.

* * * * *